United States Patent [19]

Smith

[11] 4,158,301

[45] Jun. 19, 1979

[54] METHOD AND APPARATUS FOR DECOILING SHEET MATERIAL

[76] Inventor: Jack C. Smith, Box 724, Kernersville, N.C. 27284

[21] Appl. No.: 836,352

[22] Filed: Sep. 26, 1977

[51] Int. Cl.[2] ..... B21D 3/02

[52] U.S. Cl. ..... 72/183; 72/164; 72/131; 226/143

[58] Field of Search ..... 72/183, 164, 175, 173, 72/203, 131, 4, 5; 226/143

[56] References Cited

U.S. PATENT DOCUMENTS

| | | | |
|---|---|---|---|
| 2,343,899 | 3/1944 | Groll et al. | 72/160 X |
| 3,054,315 | 9/1962 | Sarka | 226/143 X |
| 3,124,290 | 3/1964 | Lloyd | 226/143 |
| 3,187,530 | 6/1965 | Ranney | 72/183 X |
| 3,820,367 | 6/1974 | Kline | 72/128 |
| 4,047,416 | 9/1977 | Johnson | 72/183 |

*Primary Examiner*—Milton S. Mehr

*Attorney, Agent, or Firm*—Bell, Seltzer, Park & Gibson

[57] ABSTRACT

A method and apparatus for removing the coil set from a coiled roll of sheet metal material or the like, and which comprises a pair of cooperating rolls defining a nip through which the sheet metal is advanced, and a deflecting roll positioned immediately downstream of the nip to flex the advancing sheet material beyond its yield point and remove the coil set therefrom. Upon stopping of the advance to permit the cutting or other processing of the sheet material, the deflecting roll is automatically withdrawn from contact with the sheet material to thereby prevent the formation of a crease in the material, and upon restarting of the advance, the sheet material is initially reversely advanced a short distance to insure that any portion of the sheet material which has not been flexed to remove the coil set will be positioned upstream of the nip before the forward advance is commenced.

16 Claims, 6 Drawing Figures

METHOD AND APPARATUS FOR DECOILING SHEET MATERIAL

The present invention relates to a method and apparatus for removing the coil set from a coiled roll of sheet metal material or the like and which is characterized by the ability to selectively stop the advance of the sheet material to permit the cutting or other processing thereof and without imparting a crease in the material. Further, the invention is characterized by the ability to insure that all portions of the advancing sheet material will have the coil set removed therefrom, even when the sheet material is intermittently stopped and restarted.

It has long been recognized that the coiling of sheet metal into coiled rolls for shipment serves to impart an arcuate curvature to the metal, which is known in the art as coil set. Most manufactured products require that the sheet metal be substantially flat, and thus it is necessary to remove the coil set at the manufacturing plant before the sheet metal is fabricated into finished goods.

Heretofore, the coil set has been removed by withdrawing the sheet material from the coiled roll and passing it through a roller straightening apparatus which comprises two rows of several relatively small rollers. The two rows are mounted such that the peripheries of the rollers are offset, and as the sheet metal is passed between the two rows it is alternately flexed upwardly and downwardly to result in the straightening thereof, note for example the U.S. Pat. to Primich et al, No. 3,978,703. However, conventional roller straightening machines of this type are large, expensive pieces of equipment, and they are therefore not feasible for many small manufacturing operations.

It has also been proposed to remove coil set by passing the sheet metal through an arrangement consisting of three offset rolls, with two of the rolls forming a nip and the third roll acting to flex the advancing sheet material in the required direction. While this arrangement is less cumbersome and less expensive than the above-described roller straightening apparatus, it is usually not possible to stop the advance of the sheet metal through the apparatus since the application of the deflecting force to the stationary sheet material often results in the formation of a crease across the material at the point where the material is deflected. Thus machines of this type cannot be used in many instances, such as where the sheet metal is intermittently withdrawn from the coiled roll and stopped so that it may be cut or otherwise processed.

It is accordingly an object of the present invention to provide a highly efficient and relatively inexpensive method and apparatus for removing coil set from a coiled roll of sheet metal material or the like.

It is a more particular object of the present invention to provide a method and apparatus of the described type and wherein the sheet material may be intermittently advanced and stopped without imparting a crease across the material while the sheet is stationary.

It is still another object of the present invention to provide a method and apparatus of the described type and wherein the advance may be intermittently started and stopped, while insuring that all portions of the sheet material will have the coil set removed therefrom.

These and other objects and advantages of the present invention are achieved in the embodiment illustrated herein by the provision of a method and apparatus wherein the sheet material is advanced along a predetermined path of travel while a reverse bending force is applied to the sheet material sufficient to remove the coil set therefrom. The advance may be intermittently terminated to permit the cutting or other processing thereof, and upon termination of the advance the application of the reverse bending force is released to thereby prevent the formation of a crease in the stationary material. When the advance is re-established, the application of the reverse bending force is also then re-established. Preferably, the application of the reverse bending force is initially applied at a point along the length of the sheet material generally at or forwardly of the point at which the force was released when the advance was terminated, to thereby insure that all portions of the advancing sheet material will have the coil set removed therefrom. In the illustrated embodiment, this control of the point at which the reverse bending force is applied is achieved by initially reversely advancing the sheet material a relatively short distance and such that the point on the sheet material at which the force was released when the advance was terminated is brought to a position upstream of the location at which the bending force is applied.

Some of the objects having been stated, other objects will appear as the description proceeds, when taken in connection with the accompanying drawings in which.

Figure 1:
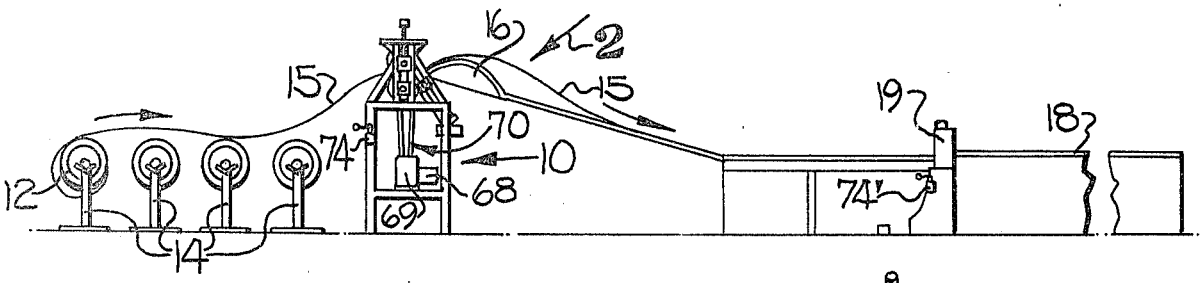
FIG. 1 is a somewhat schematic side elevation view of a manufacturing production line for processing coiled sheet material and which embodies the method and apparatus of the present invention.

Referring more specifically to the drawings, FIG. 1 illustrates an apparatus 10 embodying the features of the present invention and arranged in a production line with other equipment for withdrawing coiled sheet material from a coiled roll and cutting the sheet material to preselected lengths. More particularly, the coiled roll of sheet material being processed is indicated at 12, and is rotatably mounted on one of the four carriers 14. The sheet material 15 from the roll 12 is advanced through the apparatus 10 in the manner hereinafter further described, with the advance of the sheet material causing the roll 12 to rotate upon its carrier 14 and unwind. As is conventional, the extra carriers may be employed to provide convenient storage for additional coiled rolls in a position for immediate use.

A hump table 16 is positioned immediately downstream of the apparatus 10, and a flat cutting table 18 having a conventional cutter 19 mounted thereon is positioned downstream of the hump table. In a typical sheet cutting operation, the advance of the sheet material 15 is terminated by the operator deactivating the apparatus 10 when the leading end of the advancing sheet material reaches a predetermined point along the table 18 downstream of the cutter. The hump table 16 serves to accommodate any excess sheet material which has passed through the apparatus 10 when it has stopped, and this excess material permits the operator to manipulate the sheet material in order to square it in relation to the cutter. The cutter is then actuated to sever the stationary sheet material, the severed sheet is removed from the table 18, and the advance is recommenced by the activation of the apparatus 10.

Figure 2:
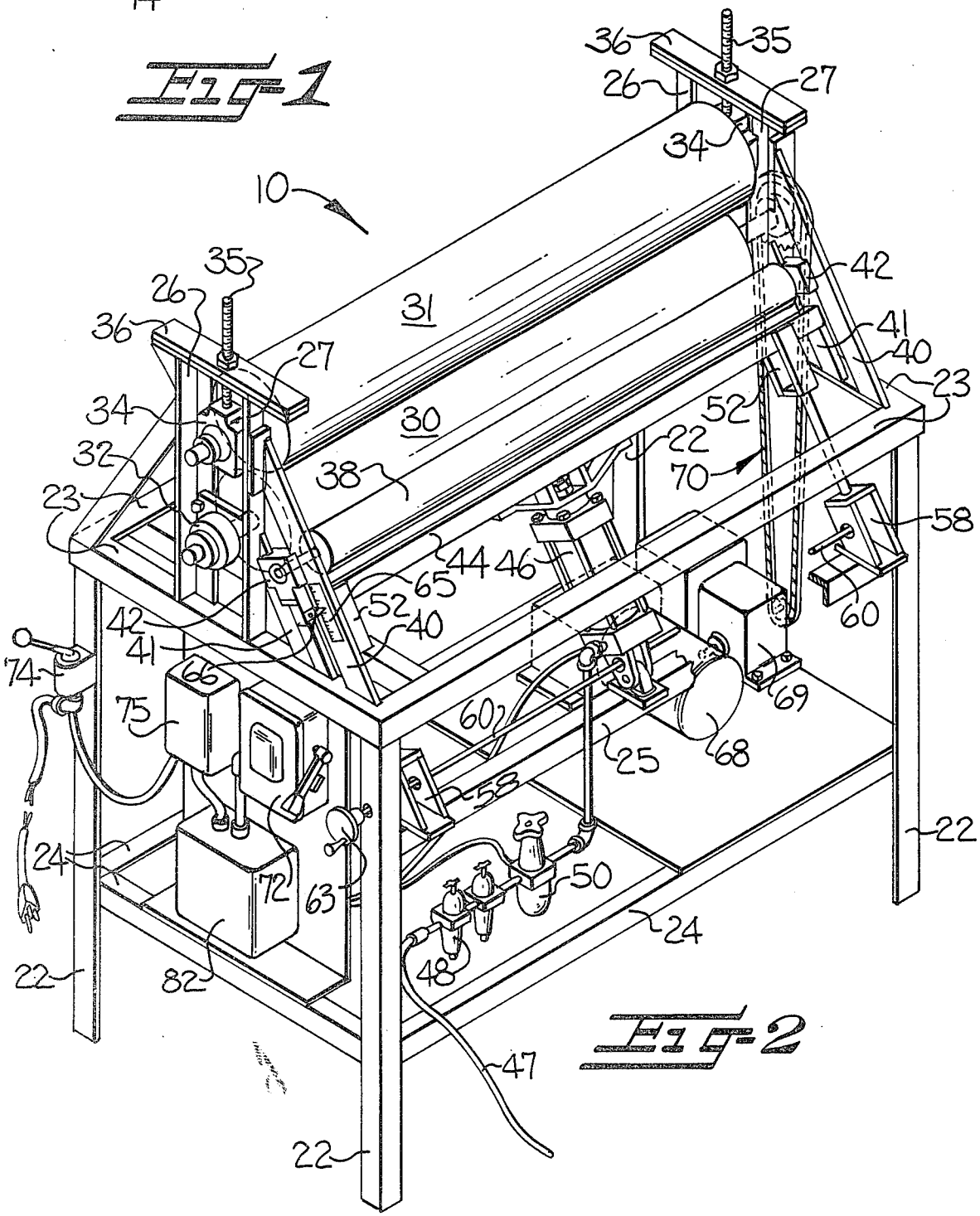
FIG. 2 is a perspective view of an apparatus which embodies the present invention.

As best seen in FIG. 2, the apparatus 10 of the present invention comprises a generally box-like support frame of suitably interconnected structural steel components. More particularly, the support frame includes four vertically directed posts 22 forming the corners, four horizontal upper members 23, and four intermediate members 24. A horizontal support member 25 is mounted between two of the posts 22 at one end of the machine for the purpose hereinafter set forth. Also, a pair of spaced apart uprights 26, 27 project upwardly from each side of the apparatus, and a pair of cooperating rollers 30, 31 are rotatably mounted between the pairs of uprights. These rolls are preferably rubber covered steel rolls, and typically are about eight inches in diameter.

Each end of the lower roll 30 is rotatably mounted in a bearing 32 which is fixed to the uprights 26, 27 so that the roll rotates about a fixed horizontal axis. Each end of the upper roll 31 is rotatably mounted in a bearing block 34 which is slideably mounted between the pair of uprights so as to permit vertical movement to thereby control the spacing across the nip of the rolls and thereby accommodate materials of varying thickness. Such adjustment is achieved by means of the threaded stud 35 which extends upwardly from each block 34 and through an upper structural member 36 which is mounted between the uprights 26 and 27. As will be apparent, the elevation of the upper roll 31 may readily be controlled by rotation of the nut positioned on each of the studs 35.

Figure 4:
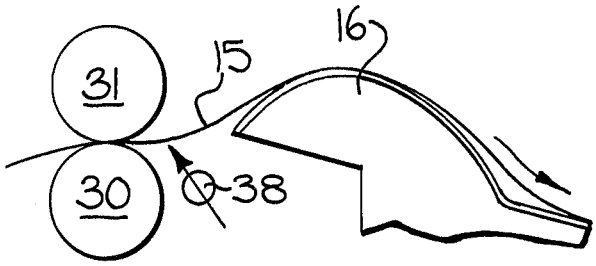
FIGS. 4 and 5 are schematic side elevation views of the cooperating rolls and deflecting roll, with the deflecting roll being shown in the non-operative and operative positions respectively.
Figure 5:
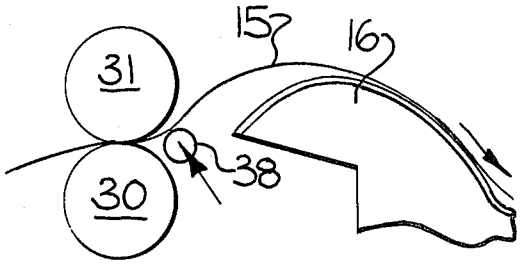

The apparatus 10 further includes a deflecting roll 38 mounted immediately downstream of the nip formed by the cooperating rolls 30, 31. The deflecting roll is typically a steel roll having a diameter of about four inches, and it is mounted for movement between an operative position (note FIG. 5) adapted to contact the advancing sheet material 15 as it leaves the nip, and a non-operative position (note FIG. 4) where it is at least substantially out of contact with the advancing sheet material.

The mounting structure for the deflecting roll includes a pair of inclined braces 40, 41 on each side of the frame of the apparatus, with the braces of each pair being spaced apart to define a trackway therebetween. A bearing block 42 is slideably mounted in each such trackway, and the roll 38 is rotatably mounted between the two bearing blocks. In addition, a rigid crossbar 44 extends between and interconnects the two blocks 42, with the crossbar being positioned generally below the roll 38.

In order to move the deflecting roll 38 between its operative and non-operative positions, there is provided a pneumatic cylinder 46 interposed between the medial portion of the crossbar 44 and the support member 25 of the frame. Pressurized air is selectively delivered to the cylinder through the line 47, which includes a conventional filter 48 and a three-way pneumatic valve 50. Thus when pressurized air is delivered to the cylinder 46 through the valve 50, the crossbar 44 and the deflecting roll 38 are translated upwardly, and when the air pressure is released to the atmosphere by the valve 50, the weight of the roll causes it to drop to its non-operative position.

Figure 3:
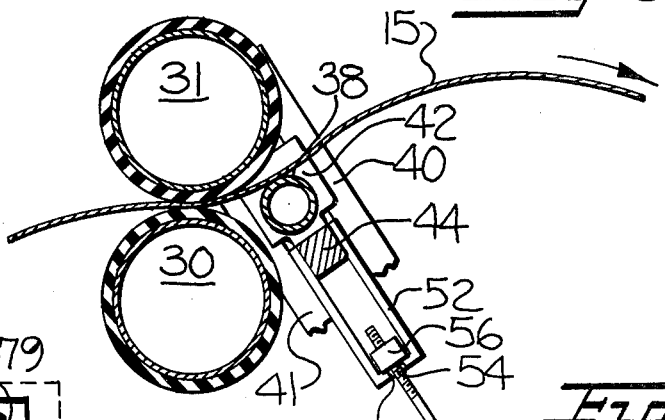
FIG. 3 is a fragmentary sectional side elevation view of the cooperating rolls and deflecting roll of the apparatus shown in FIG. 2.

Means are also provided for manually adjusting the operative position of the roll to thereby adjust the degree of deflection of the sheet material and to permit the apparatus to process different types and thicknesses of sheet material. This adjusting means comprises a bracket 52 fixed to each end of the crossbar 44, with the bracket 52 including a bottom plate 53 having an opening 54 therethrough (note FIG. 3). A threaded rod 55 extends freely through the opening 54 and a nut 56 is threadedly positioned on the rod 55 above the opening. The nut 56 is sized so that the sides of the bracket 52 preclude its rotation. The lower end of the rod 55 extends through an opening in a lower bracket 58 which is fixed to the support member 25 of the frame, and a beveled gear 59 is attached to the lower end of the rod. A control rod 60 extends horizontally across the machine and through each of the lower brackets 58, with the control rod 60 mounting a beveled gear 62 cooperating with the gear 59 on each of the rods 55. One end of the control rod 60 mounts a suitable crank 63. Thus upon rotation of the crank 63 by the operator of the machine, the rods 55 are rotated to move the associated nut 56 along the length thereof. As will be apparent, this movement of the nut 56 acts to change the upper limit of the movement of the brackets 52, and thus the upper or operative position of the deflecting roll 38. If desired, a suitable indicator 65 may be mounted on the brace 40, and a pointer 66 mounted on the block 42 to visually indicate the operative position of the roll 38, and thereby permit the machine to be readily adjusted to accommodate varying sheet materials.

Typically, the operative position of the deflecting roll 38 is very close to the nip of the rolls 30, 31 and such that a portion of the deflecting roll is positioned above a plane which extends horizontally through the nip. In certain instances, the surface of the deflecting roll 38 is spaced little more than the thickness of the sheet material 15 from the surface of the upper roll 31, but as will be understood, the exact positioning of the roll 38 in relation to the nip will depend upon a number of factors including the nature of the material being processed.

Means are also provided for advancing the sheet material through the nip defined by the cooperating rollers 30, 31. This advancing means includes a reversible electric motor 68 which acts through the gear reduction box 69, and drive chain and sprocket assembly 70, with the assembly 70 being operatively connected to the mounting shaft of the lower roll 30 such that the roll 30 is rotated about its axis by the motor 68.

An electrical control system is provided for selectively starting and stopping the rotation of the roll 30, and thus the advance of the sheet material 15 through the apparatus 10. In addition, the control system includes provision for automatically causing the deflecting roll 38 to move from its operative position to its non-operative position upon stopping the advance, and for moving the deflecting roll from its non-operative position to its operative position upon starting of the advancing means. Further, the control system acts to initially reversely advance the sheet material a short distance upon the starting of the advance of the sheet material.

Figure 6:
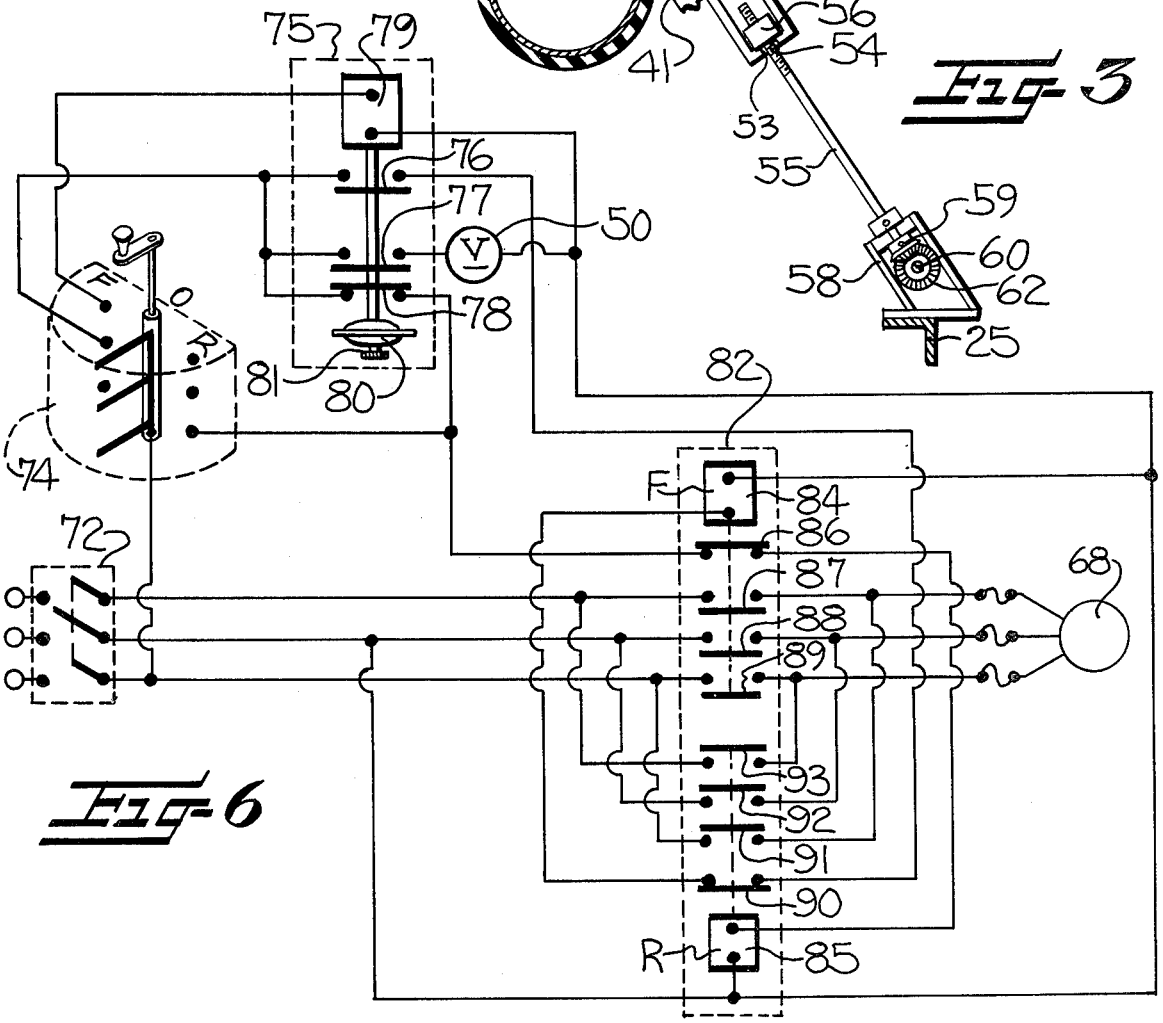
FIG. 6 is a schematic wiring diagram of a circuit for controlling the operation of the apparatus in accordance with the present invention.

The above electrical control system is illustrated somewhat schematically in FIG. 6, and comprises a master switch 72 for delivering three phase electrical power to the system. One line from the switch 72 is connected to the reversing drum switch 74 which has a forward position F, a reverse position R and a stop position (as illustrated). The two lines from the forward position of the switch 74 lead to a pneumatic timing device 75 which has two normally open contacts 76, 77, and one normally closed contact 78. Further, the timer 75 includes a solenoid 79 which moves the plunger to reverse the contacts 76–78, and a pneumatic timer 80 for delaying the movement of the plunger for a predetermined period of time (up to about 1 minute) as determined by the setting of the manual adjustment 81. A timer of this type is well known in the art, and is sold by the Square D Company. The line from the normally open contact 77 of the timer leads to the pneumatic valve 50.

The electrical control circuit further includes a reversing starter 82 for the motor 68 and which is used to reverse the direction of rotation of the motor and thus the direction of advance of the sheet material 15 through the apparatus. The starter 82 includes a forward solenoid 84 which when energized runs the motor in the forward direction, and a reverse solenoid 85 which acts to change the phase connections and run the motor in the reverse direction. Further, the starter includes a normally closed contact 86 and three normally open contacts 87, 88, 89 operatively connected to the forward solenoid 84, and a normally closed contact 90 and three normally open contacts 91, 92, 93 operatively connected to the reverse solenoid 85.

With the master switch 72 closed and the drum switch 74 at the stop position as illustrated, all contacts in the switch 74 are open and no power flows to the system. When the drum switch 74 is moved to the forward position, power immediately flows through the normally closed contacts 78 and 86 to the reverse solenoid 85 of the starter. The contacts 91, 92, 93 are closed upon actuation of the solenoid 85 and the motor 68 thus commences to run in the reverse direction. Concurrently, the solenoid 79 is actuated and the timing period as determined by the pneumatic timer 80 begins, and upon expiration of this period (typically 8 to 10 seconds in the illustrated embodiment), the timing contacts 76–78 change position. Thus contact 78 opens to deenergize the reverse solenoid 85, and contact 76 closes to send power to the forward solenoid 84 via the normally closed contact 90. The forward solenoid 84 in turn closes the contacts 87–89 to operate the motor in the forward direction. Also, the closing of the contact 77 in the timer sends power to the valve 50 causing the pneumatic cylinder to lift the deflecting roll 38 to its operative position.

As will be apparent, the motor 68 will cease operation and the deflecting roll 38 will drop to its non-operative position upon the drum switch 74 being moved to the stop position. When the drum switch 74 is moved to its reverse position, power is sent to the reverse solenoid 85 only, causing the motor to run continuously in reverse. The timer 75 and air valve 50 remain inactive.

As illustrated in FIG. 1, it may be desirable to mount a second reversing drum switch 74' at the table 18 and in parallel with the first drum switch 74, to permit the operator to control the operation while standing at either location. In such event, the normally closed contacts 86 and 90 in the starter act as a mechanical interlock to preclude the motor from trying to run in both directions in the event the two switches 74 and 74' are inadvertantly moved to different positions by the operator.

In operation, the sheet material 15 is initially threaded into the nip of the rolls 30, 31 and the operator then positions the drum switch 74 in its forward position, resulting in an initial reverse advance of a few inches, and then a continuous forward advance at a speed of, for example, about thirty feet per minute. Concurrently with the commencement of the forward advance, the valve 50 is moved to its open position, resulting in pressurized air entering the cylinder 46 and lifting the deflecting roll 38 to its operative position. By design, the deflecting roll in its operative position acts to deflect the advancing material 15 as it leaves the nip so as to flex the material beyond its yield point and remove the coil set therefrom.

When the leading end of the sheet material 15 reaches a predetermined point on the table 18, the advance is terminated by the operator moving the switch 74 to its stop position. This results in the termination of the rotation of the rolls, and the movement to the valve 50 to its exhaust position. The advance thus stops and the roll 38 drops to its non-operative position. In this regard, it will be understood that the inertia of the apparatus precludes the immediate stopping of the rolls 30, 31 and sheet material 15, and a short length of the sheet material (for example, about six to eight inches) will advance through the nip without being deflected. If the advance were then to be re-started in the forward direction, this short length would pass through the apparatus without having the coil set removed therefrom, which in most instances would result in a visible defect in the material. To avoid this result, the electrical control system as described above acts to initially reversely advance the sheet material 15 such that any portion which has not been deflected will be positioned upstream of the nip upon the starting of its forward advance. The distance of the reverse advance is determined by the setting of the adjustment 81 of the timer 75 in the manner described above.

In the drawings and specification, there has been set forth a preferred embodiment of the invention, and although specific terms are employed, they are used in a generic and descriptive sense only and not for purposes of limitation.

That which is claimed is:

1. A method for removing the coil set from a coiled roll of sheet metal material or the like and characterized by intermittently stopping the advance of the sheet material to permit the cutting or other processing thereof and without imparting a crease in the material, and comprising the steps of advancing the sheet material along a predetermined path of travel while applying a reverse bending force to the sheet material sufficient to remove the coil set therefrom as the sheet material passes a fixed location along the path of travel, terminating the advance of the sheet material and substantially concurrently releasing the application of the reverse bending force, and then re-establishing the advance of the sheet material and substantially concurrently re-establishing the application of the reverse bending force, and including initially reversely advancing the sheet material such that the point on the sheet material at which the force was released when the advance was terminated is brought to a position upstream of the location at which the bending force is applied, to thereby insure that the reverse bending force is applied to all portions of the sheet material.

2. A method for removing the coil set from a coiled roll of sheet metal material or the like and characterized by intermittently stopping the advance of the sheet material to permit the cutting or other processing thereof and without imparting a crease in the material, and comprising the sequential steps of (a) withdrawing the sheet material from the coiled roll and advancing it forwardly through the nip of a pair of cooperating rolls, while deflecting the advancing material as it leaves the nip so as to flex the material beyond its yield point and remove the coil set therefrom, (b) terminating the advance of the sheet material and substantially concurrently terminating the deflection thereof, (c) reversely advancing the sheet material a distance sufficient to insure that any portion of the sheet material which has not been flexed to remove the coil set will be positioned upstream of the nip, and then (d) re-establishing the withdrawal and forward advance of the sheet material in the manner of step (a).

3. The method as defined in claim 2 wherein the step of withdrawing and advancing the sheet material includes positively rotating at least one of said cooperating rolls.

4. The method as defined in claim 2 wherein the step of deflecting the advancing material includes contacting the advancing material with a roll positioned along an axis parallel to the axes of said cooperating rolls and immediately downstream of the nip.

5. The method as defined in claim 4 wherein the step of terminating the deflection of the sheet material includes moving the deflecting roll at least substantially out of contact with the sheet material.

6. The method as defined in claim 5 wherein the step of re-establishing the withdrawal and forward advance of the sheet material includes moving the deflecting roll into substantial contact with the sheet material.

7. An apparatus for removing the coil set from a coiled roll of sheet metal material or the like and characterized by the ability to selectively stop the advance of the sheet material to permit the cutting or other processing thereof and without imparting a crease in the material, and comprising means for withdrawing the sheet material from a coiled roll and advancing the same along a path of travel, means positioned along said path of travel for deflecting the advancing sheet material in a direction opposite the coil set, and control means for selectively operating said withdrawing and advancing means to permit the advance of the sheet material to be selectively started and stopped, and including means for automatically de-activating said deflecting means upon said sheet material being stopped and automatically re-activating said deflecting means upon the advance of the sheet material being restarted.

8. The apparatus as defined in claim 7 wherein said withdrawing and advancing means comprises a pair of cooperating rolls defining a nip therebetween and through which the sheet material is advanced.

9. The apparatus as defined in claim 8 wherein said deflecting means comprises a deflecting roll extending parallel to the axes of said cooperating rolls and positioned immediately downstream of said nip.

10. The apparatus as defined in claim 9 wherein said control means includes means for selectively moving said deflecting roll between an operative position in contact with said sheet material and a non-operative position at least substantially out of contact with said sheet material.

11. The apparatus as defined in claim 10 wherein said means for selectively moving said deflecting roll includes means for adjusting said operative position to thereby adjust the degree of deflection of the sheet material and insure that the sheet material may be deflected sufficiently to flex the material beyond its yield point and remove the coil set therefrom.

12. An apparatus for removing the coil set from a coiled roll of sheet metal material or the like and characterized by the ability to selectively stop the advance of the sheet material to permit the cutting or other processing thereof and without imparting a crease in the material, and comprising cooperating rolls defining a nip adapted to receive the sheet material therethrough, means for advancing the sheet material through said nip, a deflecting roll mounted downstream of said nip for movement between an operative position in contact with the advancing sheet material so as to flex the advancing sheet material as it leaves the nip, and a non-operative position at least substantially out of contact with said sheet material, control means for selectively starting and stopping said advancing means, and including (a) means for moving said deflecting roll from said operative position to said non-operative position upon stopping the advancing means, (b) means for initially reversely advancing the sheet material a distance sufficient to insure that any portion of the sheet material which has not been flexed by said deflecting roll will be positioned upstream of said nip, and then forwardly advancing the sheet material, upon starting of said advancing means, and (c) means for moving said deflecting roll from said non-operative position to said operative position upon or immediately after the starting of said advancing means.

13. The apparatus as defined in claim 12 wherein said advancing means comprises a reversible electric motor means for positively rotating at least one of said cooperating rolls.

14. The apparatus as defined in claim 13 wherein said means for moving said deflecting roll between said non-operative and operative positions comprises a pair of parallel trackways mounted on frame, bearing means mounting said deflecting roll for movement along said trackways, and pneumatic means for selectively moving said roll in at least one direction along said trackways and so that said roll may be moved in both directions either by said pneumatic means or the force of gravity.

15. The apparatus as defined in claim 14 wherein said control means comprises a manually operable electric switch having a forward position and a stop position, and circuit means operatively connected between said electric switch and said electric motor means for (a) actuating said pneumatic means so as to move said deflecting roll to said non-operative position upon moving said switch to its stop position, and (b) operating said motor means in the reverse direction for a predetermined time period, and then operating said motor means in the forward direction and concurrently actuating said pneumatic means so as to move said deflecting roll to said operative position, upon the switch being moved to its forward position.

16. The apparatus as defined in claim 15 wherein said electric switch further has a reverse position for continuously operating said motor means in the reverse direction.

* * * * *